US010273907B2

(12) United States Patent
Dudar et al.

(10) Patent No.: US 10,273,907 B2
(45) Date of Patent: Apr. 30, 2019

(54) SYSTEMS AND METHODS FOR ENGINE-OFF NATURAL VACUUM LEAK TESTING

(71) Applicant: Ford Global Technologies, LLC, Dearborn, MI (US)

(72) Inventors: Aed M. Dudar, Canton, MI (US); Chingpo Liu, Novi, MI (US); Dennis Seung-Man Yang, Canton, MI (US); Robert Roy Jentz, Westland, MI (US); Fling Finn Tseng, Ann Arbor, MI (US); Imad Hassan Makki, Dearborn Heights, MI (US); Russell Randall Pearce, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 278 days.

(21) Appl. No.: 14/687,792

(22) Filed: Apr. 15, 2015

(65) Prior Publication Data

US 2016/0186695 A1 Jun. 30, 2016

Related U.S. Application Data

(60) Provisional application No. 62/097,719, filed on Dec. 30, 2014.

(51) Int. Cl.
*F02M 25/08* (2006.01)

(52) U.S. Cl.
CPC ..... *F02M 25/0809* (2013.01)

(58) Field of Classification Search
CPC ..... F02M 25/0809
USPC ..... 73/40, 49.2, 49.7
See application file for complete search history.

(56) References Cited

U.S. PATENT DOCUMENTS 4,225,559 A * 9/1980 Achari ..... G01N 27/12 204/424
5,901,553 A 5/1999 Cullen
6,244,042 B1 6/2001 Dickers et al.
6,322,172 B2 11/2001 Lussier
(Continued)

FOREIGN PATENT DOCUMENTS

EP 2333290 A1 6/2011
JP 2000227364 A 8/2000

OTHER PUBLICATIONS

Anonymous, "Fuel Vapor Evaporative System Vacuum Leak Testing With External Leak Agent," IPCOM No. 000234171, Published Jan. 15, 2014, 2 pages.
(Continued)

*Primary Examiner* — Son T Le
*Assistant Examiner* — Alex T Devito
(74) *Attorney, Agent, or Firm* — Julia Voutyras; McCoy Russell LLP

(57) ABSTRACT

A method is provided, comprising terminating a pressure rise portion of an engine-off natural vacuum test based on an initial rate of change of a fuel system pressure upon sealing a fuel system; and initiating a vacuum portion of the engine-off natural vacuum test responsive to suspending the pressure rise portion. The initial rate of change may indicate a likelihood of the pressure rise portion reaching a pressure rise threshold. In this way, the vacuum portion of the test may be initiated earlier, increasing the likelihood of a conclusive result being obtained during a test time limit.

20 Claims, 9 Drawing Sheets

(56) References Cited

U.S. PATENT DOCUMENTS

| | | | |
|---|---|---|---|
| 6,374,663 | B1 | 4/2002 | Müller et al. |
| 6,550,316 | B1 | 4/2003 | Wong et al. |
| 6,679,238 | B2 | 1/2004 | Nebiyeloul-Kifle et al. |
| 6,807,851 | B2 | 10/2004 | Wakahara et al. |
| 7,004,014 | B2 | 2/2006 | Perry et al. |
| 7,140,235 | B2 | 11/2006 | McLain et al. |
| 7,272,488 | B2 | 9/2007 | Hayashi et al. |
| 7,523,653 | B2 | 4/2009 | Smith et al. |
| 7,779,626 | B2 | 8/2010 | Ohaski |
| 2006/0224283 | A1 | 10/2006 | Fussey et al. |
| 2012/0211087 | A1 | 8/2012 | Dudar et al. |
| 2014/0069394 | A1* | 3/2014 | Jentz ..... F02M 25/0809 123/520 |
| 2015/0142293 | A1 | 5/2015 | Dudar et al. |

OTHER PUBLICATIONS

Yang, D. et al., "Fuel Tank Depressurization Before Refueling a Plug-In Hybrid Vehicle," U.S. Appl. No. 14/692,487, filed Apr. 21, 2015, 39 pages.

Anonymous, An ENOV Heat Rejection Energy Aggresiveness Index, IPCOM00238410D, Aug. 25, 2014, 2 pages.

* cited by examiner

SYSTEMS AND METHODS FOR ENGINE-OFF NATURAL VACUUM LEAK TESTING

CROSS REFERENCE TO RELATED APPLICATIONS

The present application claims priority to U.S. Provisional Patent Application No. 62/097,719, entitled "SYSTEMS AND METHODS FOR ENGINE-OFF NATURAL VACUUM LEAK TESTING," filed on Dec. 30, 2014, the entire contents of which are hereby incorporated by reference for all purposes.

BACKGROUND AND SUMMARY

Vehicle emission control systems may be configured to store fuel vapors from fuel tank refueling and diurnal engine operations, and then purge the stored vapors during a subsequent engine operation. In an effort to meet stringent federal emissions regulations, emission control systems may need to be intermittently diagnosed for the presence of leaks that could release fuel vapors to the atmosphere. Evaporative leaks may be identified using engine-off natural vacuum (EONV) during conditions when a vehicle engine is not operating. In particular, a fuel system may be isolated at an engine-off event. The pressure in such a fuel system will increase if the tank is heated further (e.g., from hot exhaust or a hot parking surface) as liquid fuel vaporizes. As a fuel tank cools down, a vacuum is generated therein as fuel vapors condense to liquid fuel. Vacuum generation is monitored and leaks identified based on expected vacuum development or expected rates of vacuum development.

In order to preserve battery charge, a typical EONV test is subject to a time limit. A failure to reach a pressure or vacuum threshold before the end of the time limit may result in degradation being indicated, even if the fuel system is intact. The pressure rise portion of the test may execute until the fuel tank pressure curve reaches a zero-slope. If the pressure rise has a relatively low rate of constant increase (e.g., due to cool ambient conditions counteracting the pressure increase), and a significant amount of the time limit elapses prior to a zero-slope moment, the subsequent vacuum test may fail based on the limited amount of time remaining, regardless of the state of the fuel system.

Further, the entry conditions and thresholds for a typical EONV test are based on an inferred total amount of heat rejected into the fuel tank during the prior drive cycle. The inferred amount of heat may be based on engine run-time, integrated mass air flow, etc. However, the timing of heat energy transfer to the fuel tank significantly effects the fuel tank temperature at the initiation of the EONV test. A period of high-speed driving followed by a period of idling would indicate a high total amount of heat rejected, but much of the heat would dissipate from the tank during the idling period.

The inventors herein have recognized the above issues, and have developed systems and methods to at least partially address them. In one example, a method is provided, comprising terminating a pressure rise portion of an engine-off natural vacuum test based on an initial rate of change of a fuel system pressure upon sealing a fuel system; and initiating a vacuum portion of the engine-off natural vacuum test responsive to suspending the pressure rise portion. The initial rate of change may indicate a likelihood of the pressure rise portion reaching a pressure rise threshold. In this way, the vacuum portion of the test may be initiated earlier, increasing the likelihood of a conclusive result being obtained during a test time limit.

In another example, a method is provided, comprising: adjusting an evaporative emissions leak test parameter based on a time-weighted driving aggressiveness index; and indicating degradation based on the adjusted parameter. The time-weighted driving aggressiveness may provide a more accurate depiction of the heat rejected to the fuel tank at the point of initiating the evaporative emissions leak test. In this way, the leak test parameters may be more indicative of the current operating conditions, decreasing the likelihood of false failures. The adjusted parameters may include a pressure rise threshold and/or a vacuum threshold. In this way, the expected pressure change may reflect the amount of heat rejected to the fuel tank during the previous drive cycle. In some examples, the amount of heat rejected to the fuel tank may additionally or alternatively be based on an exhaust system temperature. The exhaust system temperature may be based on a resistance of a heating element coupled within a heated exhaust gas oxygen sensor. In this way, a liquid fuel temperature may be inferred without requiring a dedicated fuel temperature sensor or exhaust temperature sensor.

BRIEF DESCRIPTIONS OF THE DRAWINGS

FIG. 1 schematically shows a fuel system and an emissions system for an example vehicle engine.

Figure 7:
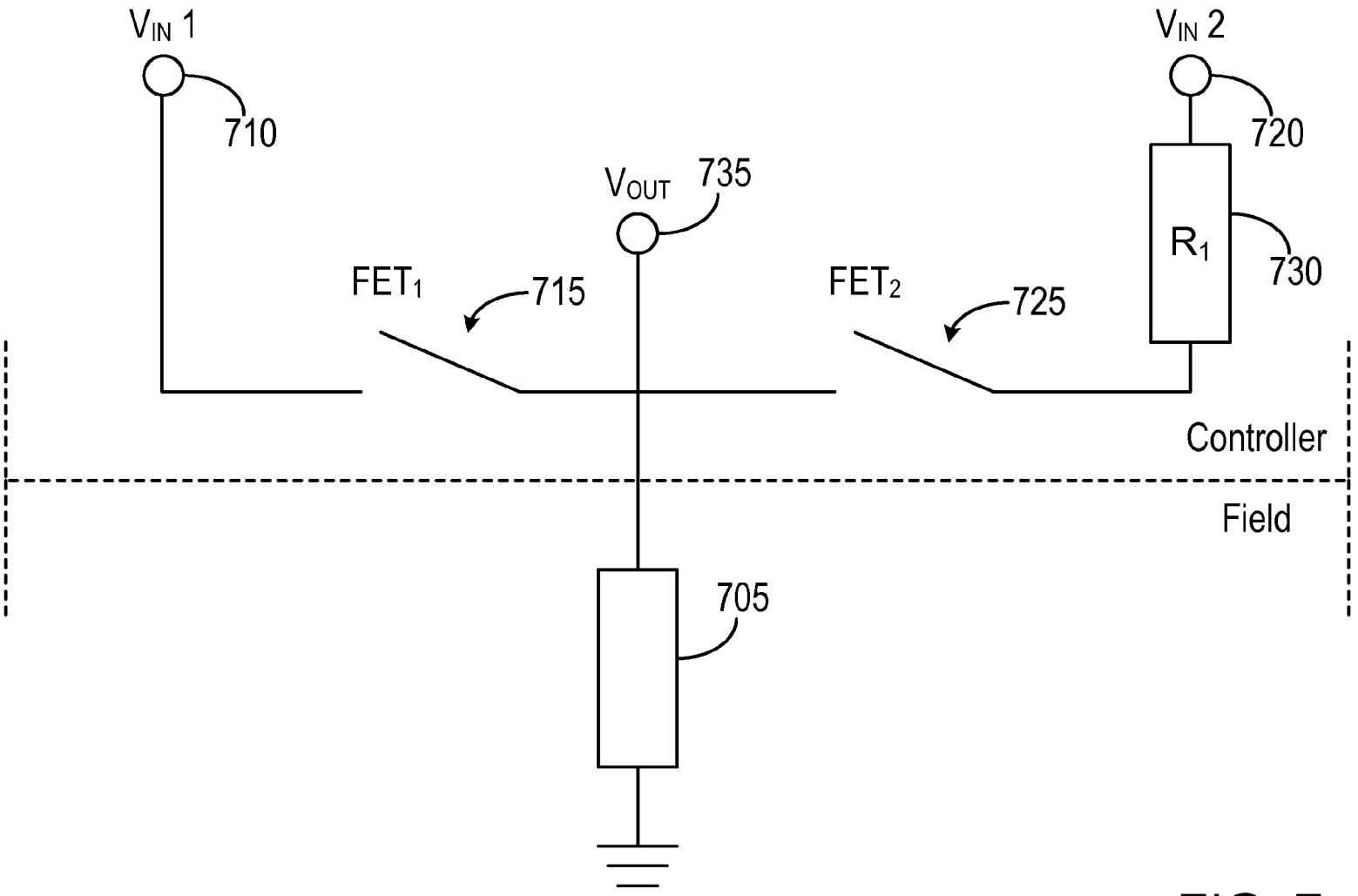

FIG. 7 schematically shows an example circuit for a heated exhaust gas oxygen sensor.

Figure 8:
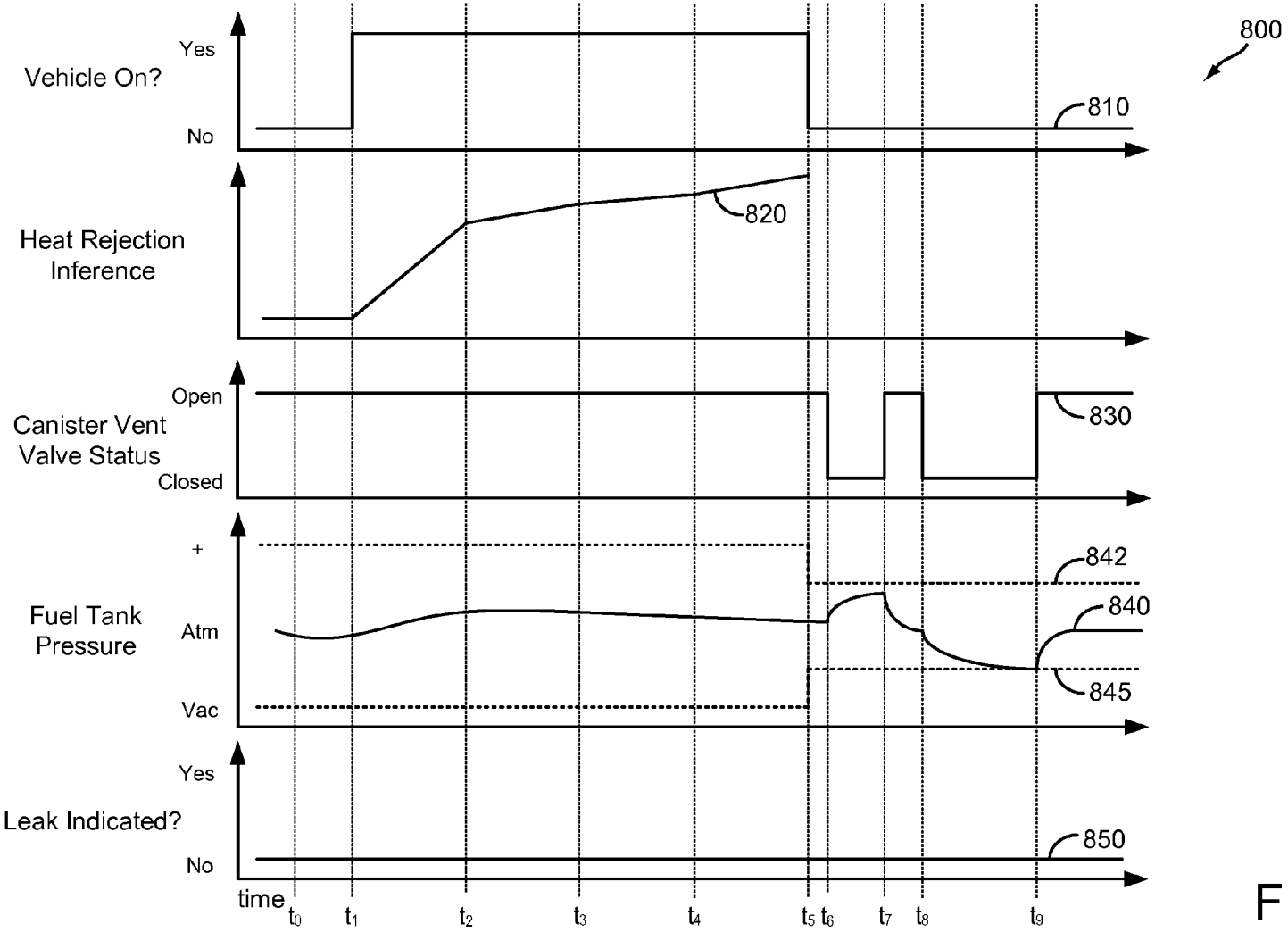

FIG. 8 shows an example timeline for an engine-off natural vacuum test.

DETAILED DESCRIPTION

Figure 1:
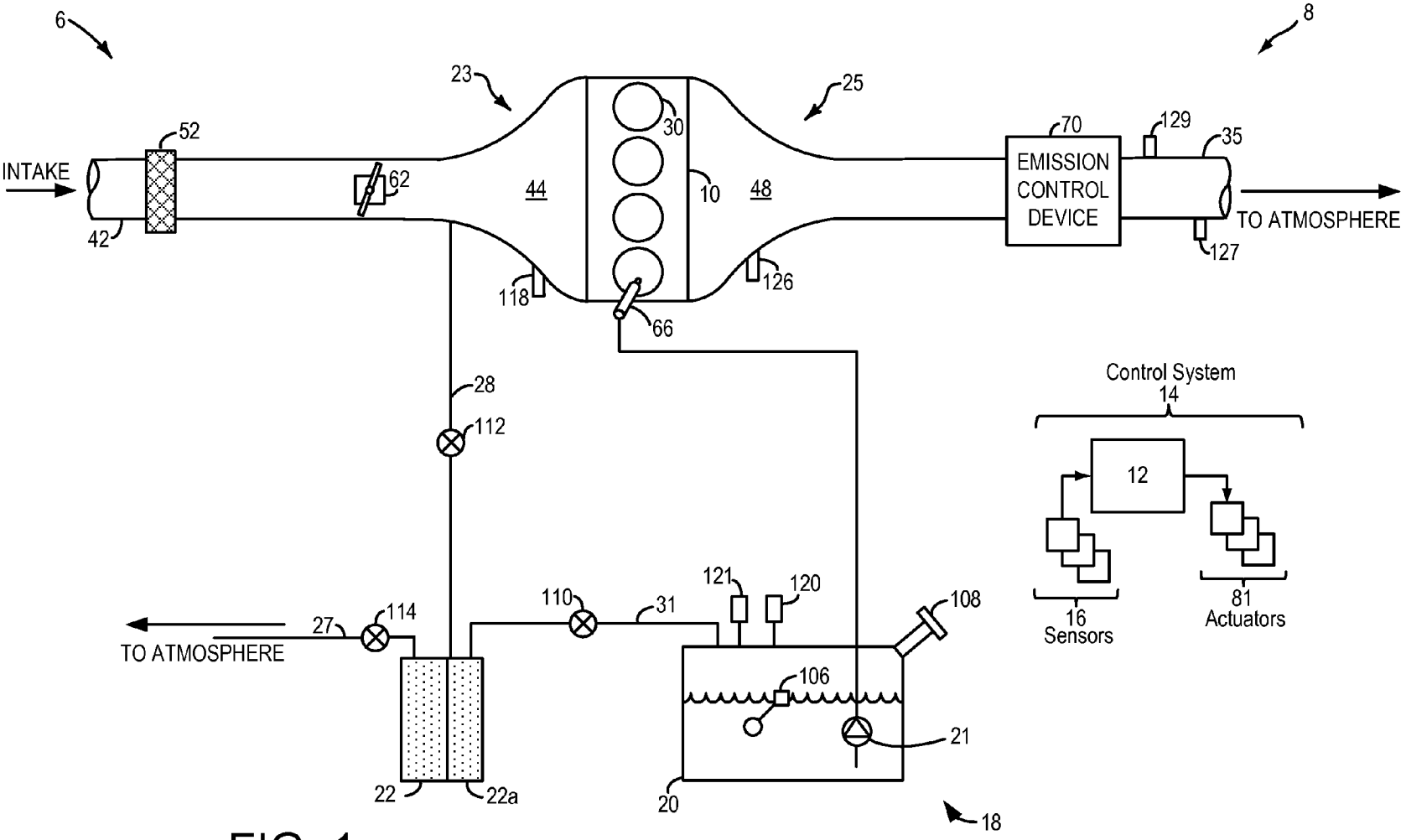
Figure 3:
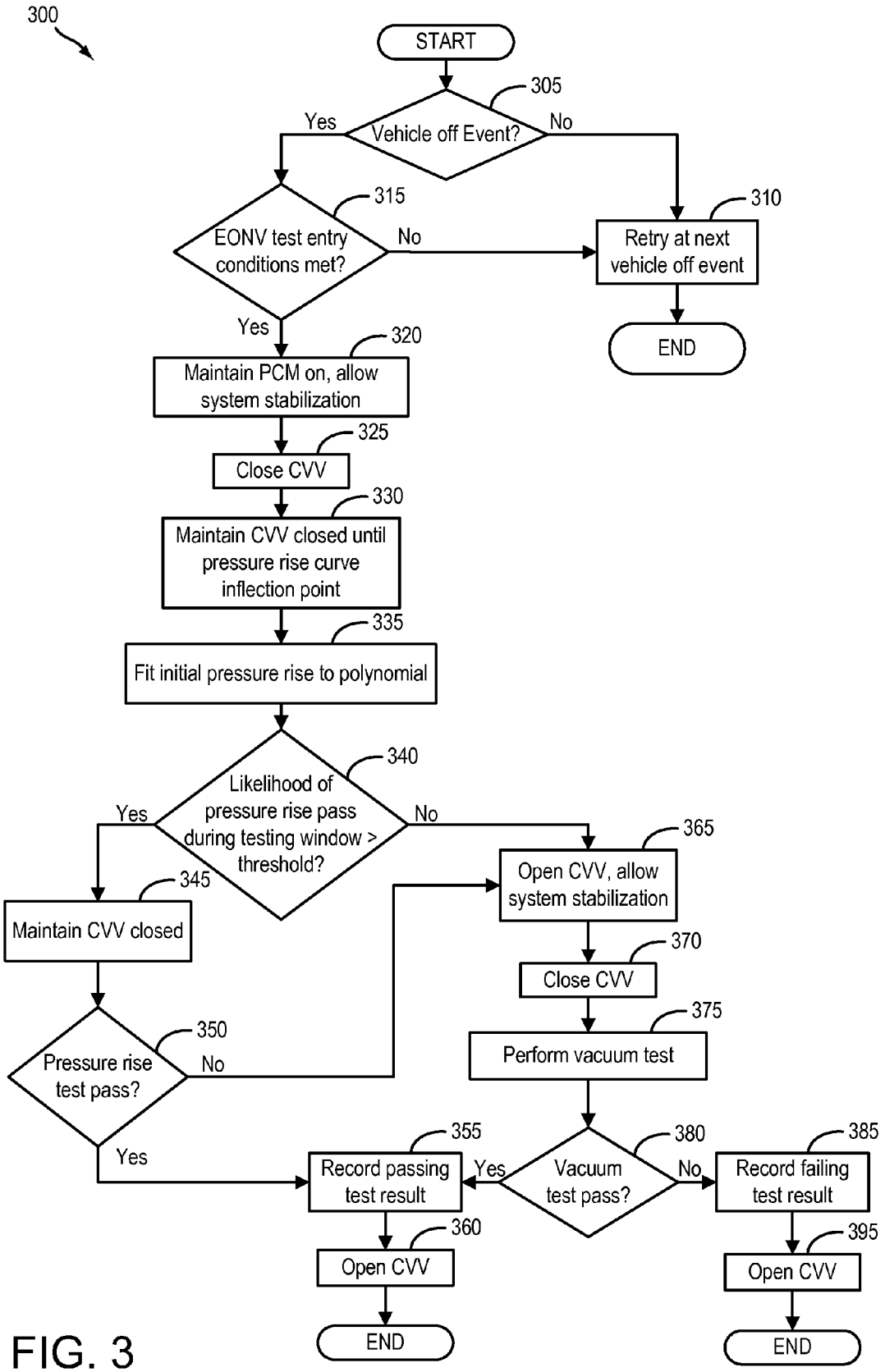
FIG. 3 shows a flow-chart for a high-level method for an engine-off natural vacuum test.
Figure 4A:
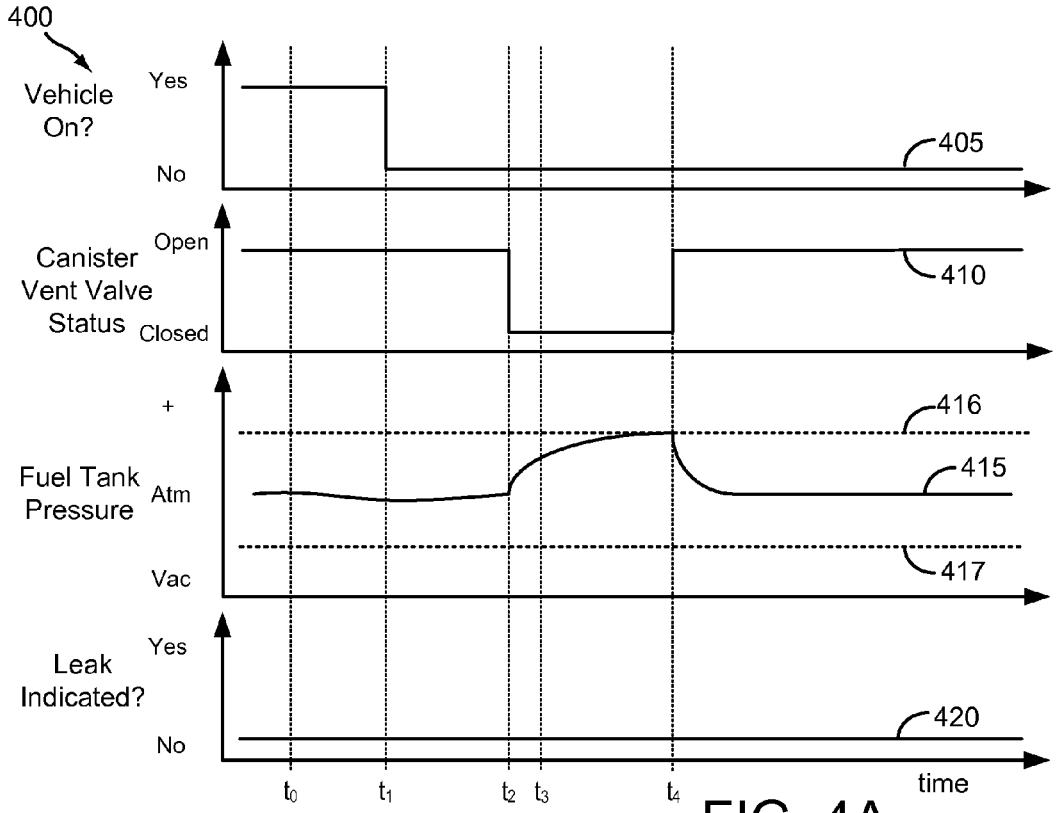
FIGS. 4A-4B show example timelines for engine-off natural vacuum tests.
Figure 4B:
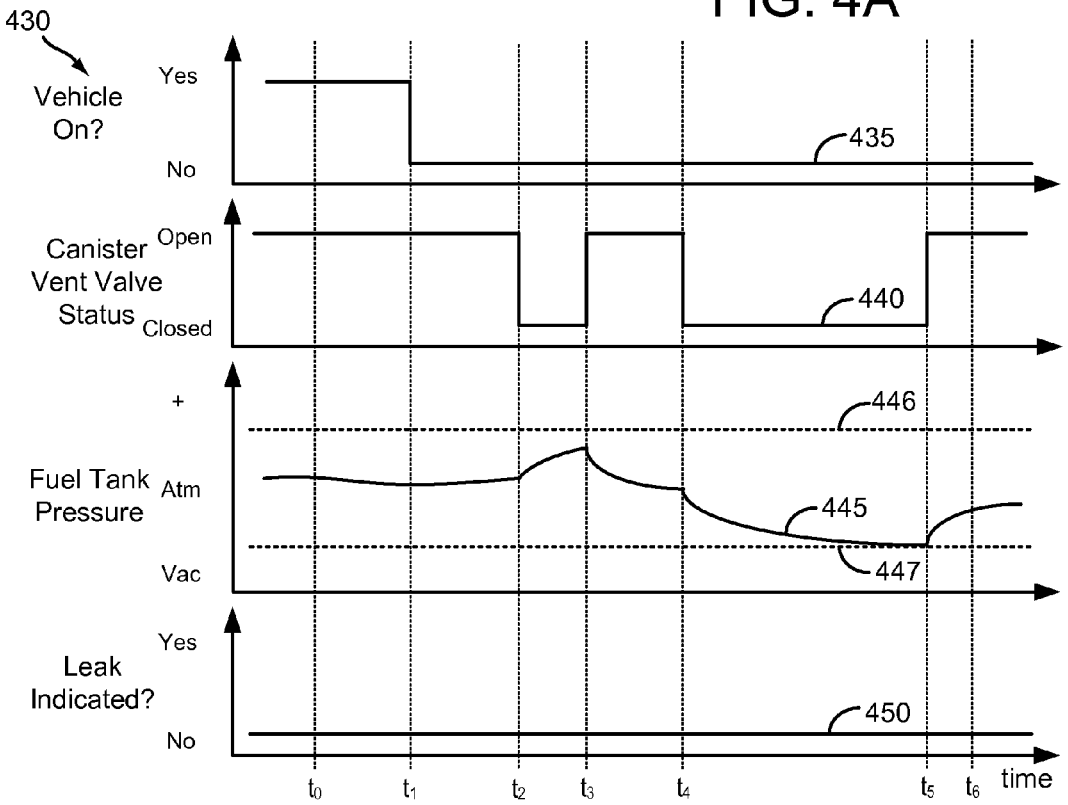
Figure 5:
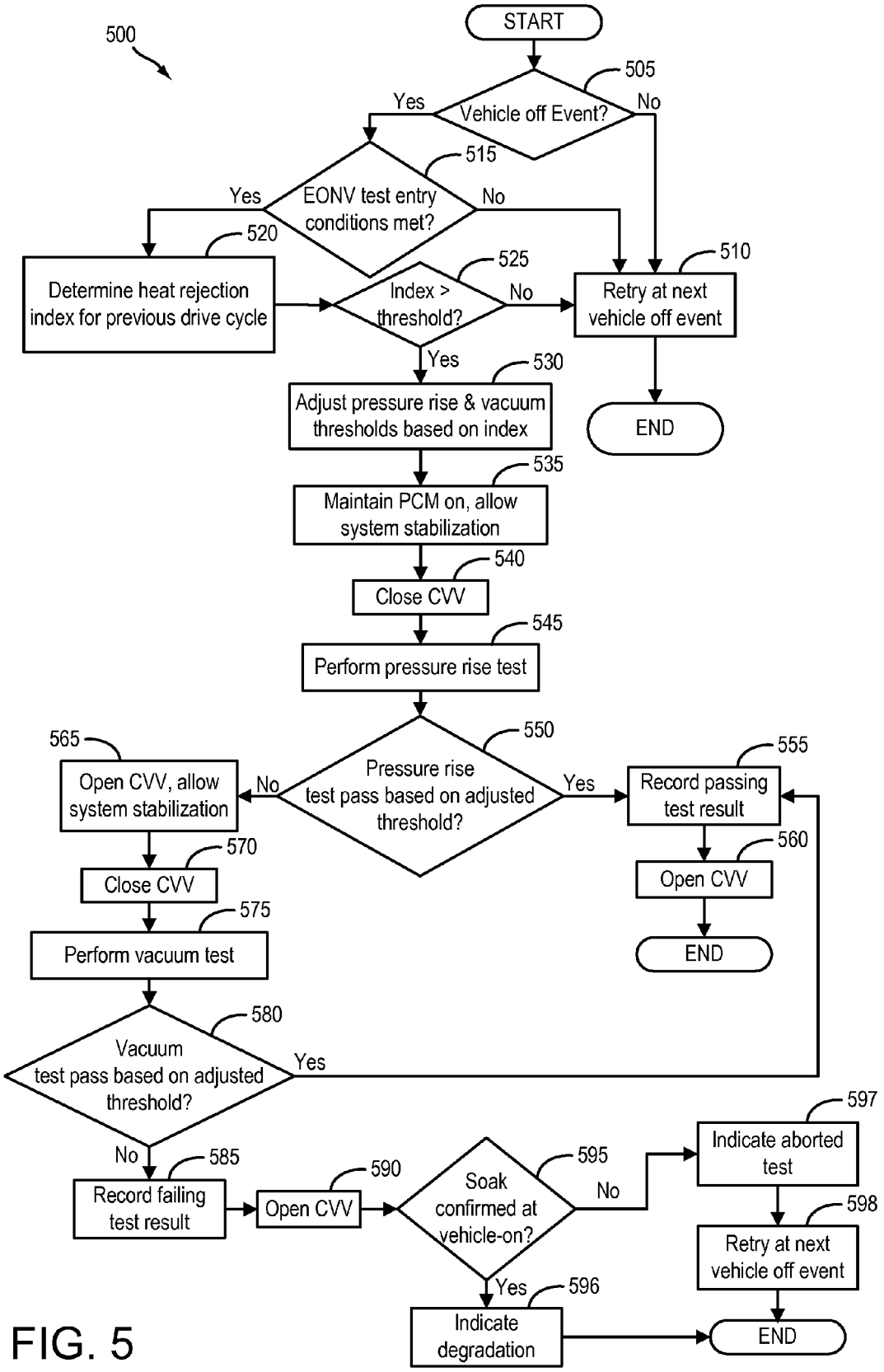
FIG. 5 shows a flow-chart for a high-level method for an engine-off natural vacuum test.

The detailed description relates to systems and methods for evaporative emissions system leak testing. More specifically, the description relates to adjusting entry conditions, and parameters for executing an engine-off natural vacuum test. The evaporative emission system may be coupled to a fuel system and an engine, as depicted in FIG. 1. Following a drive cycle, if the fuel system is sealed, the fuel system pressure may initially increase as fuel vaporizes, then decrease as fuel vapor condenses, as shown in the time plots of FIGS. 2A-2D. By fitting the initial pressure rise rate to a polynomial, the likelihood of the test passing on the pressure rise portion may be determined, and the pressure rise portion terminated if the likelihood is below a threshold. A method for an EONV test that incorporates this concept is shown in FIG. 3, and a timeline for such EONV tests are shown in FIGS. 4A-4B. A heat rejection index may be determined following a drive cycle in order to estimate the temperature of the bulk liquid fuel. The heat rejection index may be used to adjust test thresholds, and may further be used as an entry condition. A method for an EONV test that incorporates this concept is shown in FIG. 5, and a timeline for such an EONV test is shown in FIG. 8. The heat rejected from the engine to the fuel tank may vary over time, as shown in FIG.

6. By weighting more recent heat rejection, a drive cycle aggressiveness index may be determined, providing an accurate representation of the fuel tank conditions at a vehicle-off event. In some examples, the heat rejection index may be based on an exhaust system temperature. The exhaust system temperature may be determined based on the resistance of a heating element for an exhaust gas oxygen sensor. The heating element may be configured such that the exhaust system temperature may be gauged during vehicle-off conditions, or when the heater is not being used, as shown in FIG. 7. The exhaust system temperature may further be used as a proxy for fuel temperature following a vehicle soak, as it may track more closely to fuel temperature than does engine coolant temperature, for example.

FIG. 1 shows a schematic depiction of a hybrid vehicle system 6 that can derive propulsion power from engine system 8 and/or an on-board energy storage device, such as a battery system (not shown). An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18. Fuel system 18 includes a fuel tank 20 coupled to a fuel pump 21 and a fuel vapor canister 22. During a fuel tank refueling event, fuel may be pumped into the vehicle from an external source through refueling port 108. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via conduit 31, before being purged to the engine intake 23.

Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 by opening canister purge valve 112. While a single canister 22 is shown, it will be appreciated that fuel system 18 may include any number of canisters. In one example, canister purge valve 112 may be a solenoid valve wherein opening or closing of the valve is performed via actuation of a canister purge solenoid.

Canister 22 may include a buffer 22*a* (or buffer region), each of the canister and the buffer comprising the adsorbent. As shown, the volume of buffer 22*a* may be smaller than (e.g., a fraction of) the volume of canister 22. The adsorbent in the buffer 22*a* may be same as, or different from, the adsorbent in the canister (e.g., both may include charcoal). Buffer 22*a* may be positioned within canister 22 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Canister 22 includes a vent 27 for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In one example, canister vent valve 114 may be a solenoid valve wherein opening or closing of the valve is performed via actuation of a canister vent solenoid. In particular, the canister vent valve may be an open that is closed upon actuation of the canister vent solenoid. In some examples, an air filter may be coupled in vent 27 between canister vent valve 114 and atmosphere.

As such, hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, a fuel tank isolation valve 110 may be optionally included in conduit 31 such that fuel tank 20 is coupled to canister 22 via the valve. During regular engine operation, isolation valve 110 may be kept closed to limit the amount of diurnal or "running loss" vapors directed to canister 22 from fuel tank 20. During refueling operations, and selected purging conditions, isolation valve 110 may be temporarily opened, e.g., for a duration, to direct fuel vapors from the fuel tank 20 to canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits. While the depicted example shows isolation valve 110 positioned along conduit 31, in alternate embodiments, the isolation valve may be mounted on fuel tank 20. The fuel system may be considered to be sealed when isolation valve 110 is closed. In embodiments where the fuel system does not include isolation valve 110, the fuel system may be considered sealed when purge valve 112 and canister vent valve 114 are both closed.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 directly coupled to fuel tank 20, in alternate embodiments, the pressure sensor may be coupled between the fuel tank and canister 22, specifically between the fuel tank and isolation valve 110. In still other embodiments, a first pressure sensor may be positioned upstream of the isolation valve (between the isolation valve and the canister) while a second pressure sensor is positioned downstream of the isolation valve (between the isolation valve and the fuel tank), to provide an estimate of a pressure difference across the valve. In some examples, a vehicle control system may infer and indicate a fuel system leak based on changes in a fuel tank pressure during a leak diagnostic routine.

One or more temperature sensors 121 may also be coupled to fuel system 18 for providing an estimate of a fuel system temperature. In one example, the fuel system temperature is a fuel tank temperature, wherein temperature sensor 121 is a fuel tank temperature sensor coupled to fuel tank 20 for estimating a fuel tank temperature. While the depicted example shows temperature sensor 121 directly coupled to fuel tank 20, in alternate embodiments, the temperature sensor may be coupled between the fuel tank and canister 22.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may open isolation valve 110 and canister vent valve 114 while closing canister purge valve (CPV) 112 to direct refueling vapors into canister 22 while preventing fuel vapors from being directed into the intake manifold.

As another example, the fuel system may be operated in a refueling mode (e.g., when fuel tank refueling is requested by a vehicle operator), wherein the controller 12 may open isolation valve 110 and canister vent valve 114, while maintaining canister purge valve 112 closed, to depressurize the fuel tank before allowing enabling fuel to be added therein. As such, isolation valve 110 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 12 may open canister purge valve 112 and canister vent valve while closing isolation valve 110. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include heated exhaust gas oxygen sensor (HEGO) 126 located upstream of the emission control device, catalyst monitor sensor (CMS) 127 located downstream of the emission control device, MAP sensor 118, pressure sensor 120, and pressure sensor 129. Other sensors such as additional pressure, temperature, air/fuel ratio, and composition sensors may be coupled to various locations in the vehicle system 6. For example, ambient temperature and pressure sensors may be coupled to the exterior of the vehicle body. As another example, the actuators may include fuel injector 66, isolation valve 110, purge valve 112, vent valve 114, fuel pump 21, and throttle 62.

Control system 14 may further receive information regarding the location of the vehicle from an on-board global positioning system (GPS). Information received from the GPS may include vehicle speed, vehicle altitude, vehicle position, etc. This information may be used to infer engine operating parameters, such as local barometric pressure. Control system 14 may further be configured to receive information via the internet or other communication networks. Information received from the GPS may be cross-referenced to information available via the internet to determine local weather conditions, local vehicle regulations, etc. Control system 14 may use the internet to obtain updated software modules which may be stored in non-transitory memory.

The control system 14 may include a controller 12. Controller 12 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines. Example control routines are described herein with regard to FIGS. 3 and 5.

Controller 12 may also be configured to intermittently perform leak detection routines on fuel system 18 (e.g., fuel vapor recovery system) to confirm that the fuel system is not degraded. As such, various diagnostic leak detection tests may be performed while the engine is off (engine-off leak test) or while the engine is running (engine-on leak test). Leak tests performed while the engine is running may include applying a negative pressure on the fuel system for a duration (e.g., until a target fuel tank vacuum is reached) and then sealing the fuel system while monitoring a change in fuel tank pressure (e.g., a rate of change in the vacuum level, or a final pressure value). Leak tests performed while the engine is not running may include sealing the fuel system following engine shut-off and monitoring a change in fuel tank pressure. This type of leak test is referred to herein as an engine-off natural vacuum test (EONV). In sealing the fuel system following engine shut-off, a vacuum will develop in the fuel tank as the tank cools and fuel vapors are condensed to liquid fuel. The amount of vacuum and/or the rate of vacuum development may be compared to expected values that would occur for a system with no leaks, and/or for a system with leaks of a predetermined size. Following a vehicle-off event, as heat continues to be rejected from the engine into the fuel tank, the fuel tank pressure will initially rise. During conditions of relatively high ambient temperature, a pressure build above a threshold may be considered a passing test.

Figure 2A:
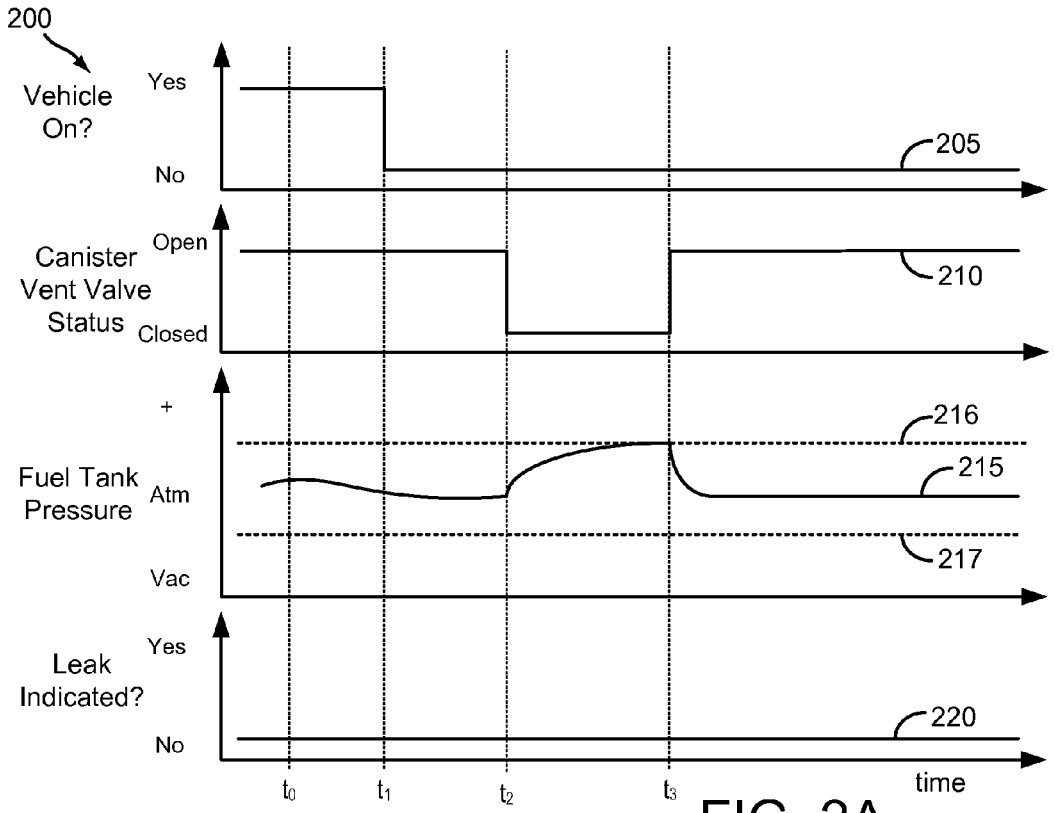
FIGS. 2A-2D show example timelines for engine-off natural vacuum tests on an intact fuel tank.

For example, FIG. 2A shows an example timeline 200 for an EONV test on an intact fuel tank which passes during the pressure rise portion of the test. Timeline 200 includes plot 205, indicating a vehicle-on status over time, plot 210, indicating a canister vent valve over time, and plot 215, indicating a fuel tank pressure over time. Line 216 represents a pressure threshold for the pressure rise portion of an EONV test. Line 217 represents a vacuum threshold for the vacuum portion of an EONV test. Timeline 200 further includes plot 220, indicating whether a leak is indicated.

At time $t_0$, the vehicle is off, as indicated by plot 205. Accordingly, the canister vent valve is open, as indicated by plot 210. At time $t_1$, the vehicle is turned off. The canister vent valve is left open from time $t_1$ to time $t_2$ to allow system stabilization. At time $t_2$, the canister vent valve is closed, and the fuel tank pressure increases, as indicated by plot 215. At time $t_3$, the fuel tank pressure reaches the pressure threshold represented by line 216. Accordingly, the canister vent valve is opened, allowing the fuel tank pressure to return to atmospheric pressure. No leak is indicated, as indicated by plot 220, and the EONV test is completed without performing the vacuum portion of the test.

In scenarios where the fuel tank pressure rise fails to meet the pressure threshold, the canister vent valve is opened, allowing the fuel tank pressure to stabilize, then closed, allowing a vacuum to develop. Typically, the pressure rise portion of the EONV test is aborted when the pressure rise stalls, for example, as indicated by a zero-slope in the fuel tank pressure curve.

Figure 2B:
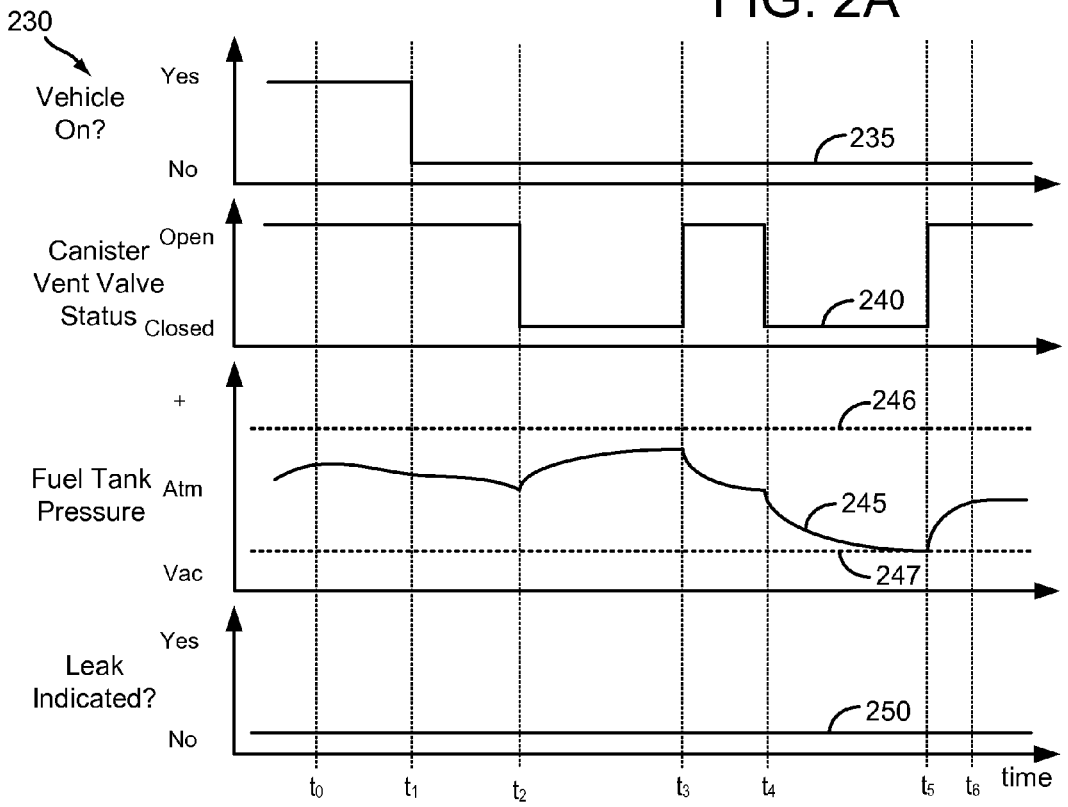

For example, FIG. 2B shows an example timeline 230 for an EONV test on an intact fuel tank which passes during the vacuum portion of the test. Timeline 230 includes plot 235, indicating a vehicle-on status over time, plot 240, indicating a canister vent valve status over time, and plot 245, indicating a fuel tank pressure over time. Line 246 represents a pressure threshold for the pressure rise portion of an EONV test. Line 247 represents a vacuum threshold for the vacuum portion of an EONV test. Timeline 230 further includes plot 250, indicating whether a leak is indicated over time.

At time $t_0$, the vehicle is off, as indicated by plot 235. Accordingly, the canister vent valve is open, as indicated by plot 240. At time $t_1$, the vehicle is turned off. The canister vent valve is left open from time $t_1$ to time $t_2$ to allow system stabilization. At time $t_2$, the canister vent valve is closed, and the fuel tank pressure increases, as indicated by plot 245. At time $t_3$, the fuel tank pressure reaches a zero-slope plateau. Accordingly, the canister vent valve is opened, allowing the fuel tank pressure to return to atmospheric pressure, but no leak is indicated, as indicated by plot 250.

At time $t_4$, the fuel tank pressure has returned to atmospheric pressure. The canister vent valve is then closed. As heat continues to dissipate from the fuel tank, a vacuum develops in the fuel tank. At time $t_5$, the fuel tank vacuum reaches the vacuum threshold represented by line 247. Accordingly, the canister vent valve is opened, allowing the fuel tank pressure to return to atmospheric pressure, but no leak is indicated, as indicated by plot 250. In this way, the EONV test reaches completion prior to a test time limit indicated by time $t_6$.

Typically, the EONV test is performed with a time limit, in order to minimize the battery drain incurred from maintaining the controller on, and/or from maintaining the CVV closed. Thus, is some scenarios, fuel system degradation may be indicated even if no leak is present if the vacuum threshold has not been reached at the test time limit.

Figure 2C:
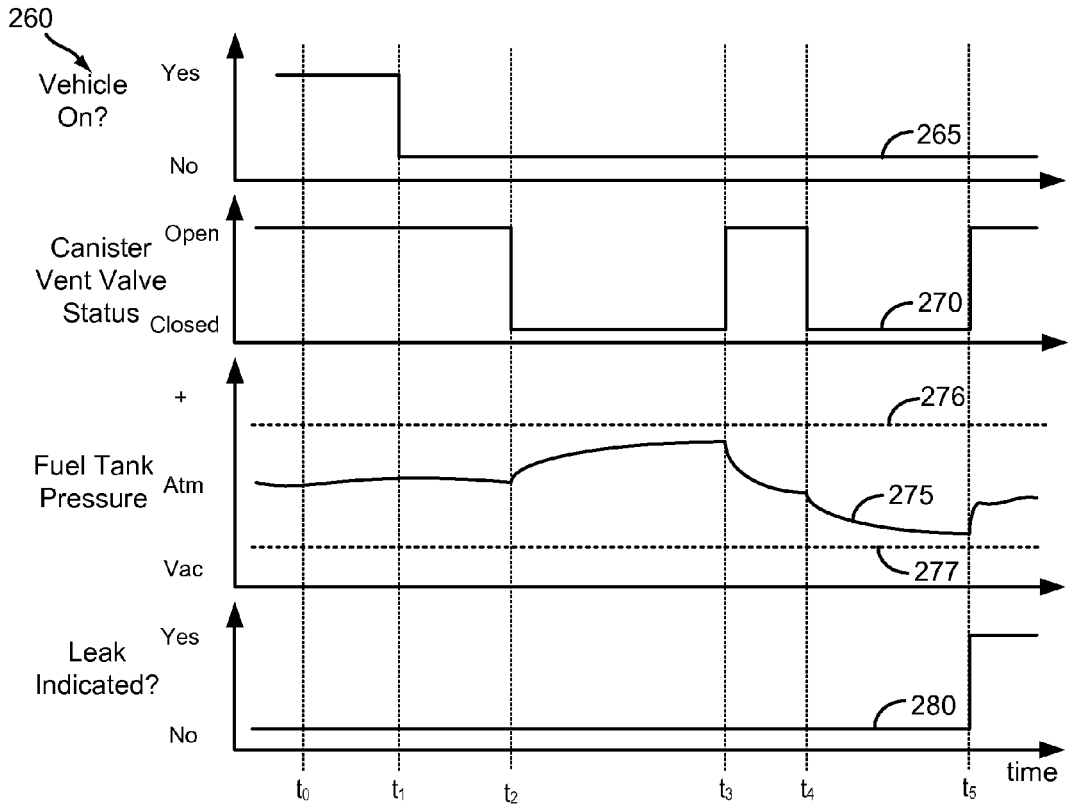

For example, FIG. 2C shows an example timeline 260 for an EONV test on an intact fuel tank which fails due to the test time limit being reached. Timeline 260 includes plot 265, indicating a vehicle-on status over time, plot 270, indicating a canister vent valve status over time, and plot 275, indicating a fuel tank pressure over time. Line 276 represents a pressure threshold for the pressure rise portion of an EONV test. Line 277 represents a vacuum threshold for the vacuum portion of an EONV test. Timeline 260 further includes plot 280, indicating whether a leak is indicated over time.

At time $t_0$, the vehicle is off, as indicated by plot 265. Accordingly, the canister vent valve is open, as indicated by plot 270. At time $t_1$, the vehicle is turned off. The canister vent valve is left open from time $t_1$ to time $t_2$ to allow system stabilization. At time $t_2$, the canister vent valve is closed, and the fuel tank pressure increases, as indicated by plot 275. At time $t_3$, the fuel tank pressure reaches a zero-slope plateau. Accordingly, the canister vent valve is opened, allowing the fuel tank pressure to return to atmospheric pressure, but no leak is indicated, as indicated by plot 280.

At time $t_4$, the fuel tank pressure has returned to atmospheric pressure. The canister vent valve is then closed. As heat continues to dissipate from the fuel tank, a vacuum develops in the fuel tank. However, the test time limit is reaches at time $t_5$, prior to the fuel tank vacuum reaching the vacuum threshold represented by line 277. Accordingly, a leak is indicated, and the canister vent valve is opened.

In FIG. 2C, the fuel tank vacuum may have reached the vacuum threshold had the test been extended, or had the vacuum portion of the test begun earlier. Indeed, the pressure build phase accounted for a significant amount of the time limit, even though the pressure threshold was not reached. By aborting the pressure rise portion earlier in scenarios where the pressure threshold is unlikely to be reached, the vacuum portion of the test may begin earlier, and may decrease the likelihood of false failures.

Figure 2D:
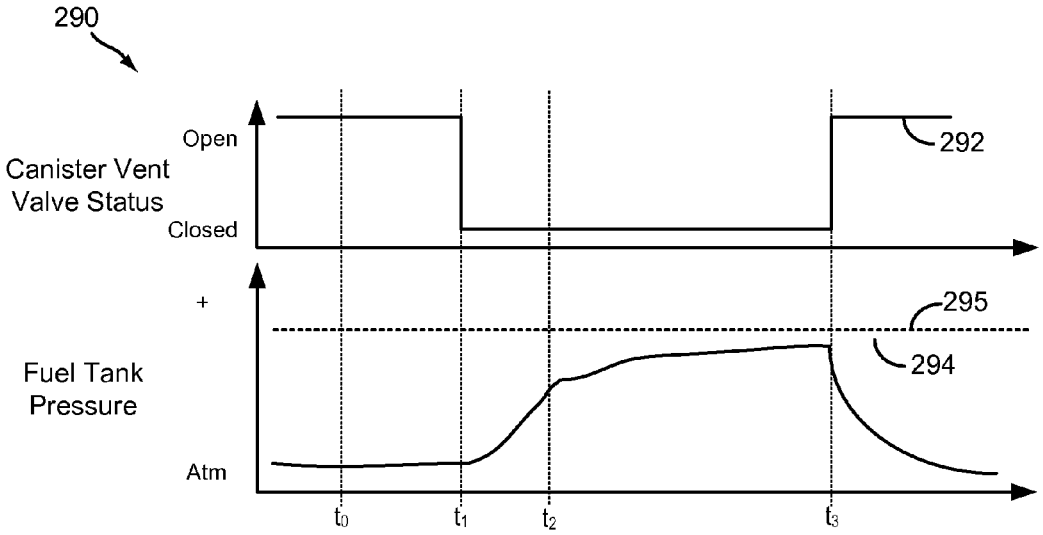

FIG. 2D shows a detailed view of an example timeline 290 for the pressure rise portion of an EONV test. Timeline 290 includes plot 292, indicating a canister vent valve status over time, and plot 294, indicating a fuel tank pressure over time. Line 295 represents a pressure threshold for the pressure rise portion of an EONV test. The canister vent valve is left open from time $t_0$ to time $t_1$ to allow system stabilization. At time $t_1$, the canister vent valve is closed, and the fuel tank pressure increases, as indicated by plot 275. At time $t_2$, the pressure curve reaches an inflection point. At time $t_3$, the fuel tank pressure reaches a zero-slope plateau. Accordingly, the canister vent valve is opened, allowing the fuel tank pressure to return to atmospheric pressure.

However, the time spent in the pressure rise portion was not informative, and may have decreased the likelihood of the vacuum test running completion prior to the test time limit. In order to prevent this, the initial pressure rise may be used to determine the likelihood of the pressure rise portion reaching the pressure threshold. In some examples, the initial pressure rise may comprise the duration between the initial closing of the canister and the pressure curve inflection point (e.g., time $t_1$ to time $t_2$ in FIG. 2D). A polynomial fit (e.g., $Y=f(x)$) may be regressed to the initial pressure rise data over time. The pressure pass threshold may then be inserted into the equation to determine whether the pressure is likely to reach the threshold during the test time limit (e.g., 45 minutes). If the pressure is not likely to reach the threshold, the canister vent valve may be opened, equilibrating the system pressure, and allowing for the vacuum portion of the test to be initiated.

FIG. 3 depicts a high-level method 300 for an engine-off natural vacuum test for a vehicle where the likelihood of the pressure rise reaching a pass threshold is predicted based on the initial pressure rise data. Method 300 will be described with relation to the system depicted in FIG. 1, but it should be understood that similar methods may be used with other systems without departing from the scope of this disclosure. Method 300 may be carried out by a controller, such as controller 12, and may be stored as executable instructions in non-transitory memory.

Method 300 begins at 305. At 305, method 300 includes determining whether a vehicle-off event has occurred. The vehicle-off event may include an engine-off event, and may be indicated by other events, such as a key-off event. The vehicle-off event may follow a vehicle run time duration, the vehicle run time duration commencing at a previous vehicle-on event. If no vehicle-off event is detected, method 300 proceeds to 310. At 310, method 300 includes recording that an EONV test was not executed, and further includes setting a flag to retry the EONV test at the next detected vehicle-off event. Method 300 then ends.

If a vehicle-off event is detected, method 300 proceeds to 315. At 315, method 300 includes determining whether entry conditions for an EONV test are met. For an engine-off natural vacuum test, the engine must be at rest with all cylinders off, as opposed to engine operation with the engine rotating, even if one or more cylinders are deactivated. Further entry conditions may include a threshold amount of time passed since the previous EONV test, a threshold length of engine run time prior to the engine-off event, a threshold amount of fuel in the fuel tank, and a threshold battery state of charge. If entry conditions are not met, method 300 proceeds to 310. At 310, method 300 includes recording that an EONV test was not executed, and further includes setting a flag to retry the EONV test at the next detected vehicle-off event. Method 300 then ends.

Although entry conditions may be met at the initiation of method 300, conditions may change during the execution of the method. For example, an engine restart or refueling event may be sufficient to abort the method at any point prior to completing method 300. If such events are detected that would interfere with the performing of method 300 or the interpretation of results derived from executing method 300, method 300 may proceed to 310, record that an EONV test was aborted, and set a flag to retry the EONV test at the next detected vehicle-off event, and then end.

If entry conditions are met, method 300 proceeds to 320. At 320, method 300 includes maintaining the PCM on despite the engine-off and/or vehicle off condition. In this way, the method may continue to be carried out by a controller, such as controller 12. Method 300 further includes allowing the fuel system to stabilize following the engine-off condition. Allowing the fuel system to stabilize may include waiting for a period of time before method 300 advances. The stabilization period may be a pre-determined amount of time, or may be an amount of time based on current operating conditions. The stabilization period may be based on the current ambient conditions and/or the ambient conditions predicted for the test time period. In some examples, the stabilization period may be characterized as the length of time necessary for consecutive measurements of a parameter to be within a threshold of each other. For example, fuel may be returned to the fuel tank from other fuel system components following an engine off condition. The stabilization period may thus end when two or more consecutive fuel level measurements are within a threshold amount of each other, signifying that the fuel level in the fuel tank has reached a steady-state. In some examples, the stabilization period may end when the fuel tank pressure is equal to atmospheric pressure. Following the stabilization period, method 300 then proceeds to 325.

At 325, method 300 includes closing a canister vent valve (CVV). Additionally or alternatively, a fuel tank isolation valve (FTIV) may be closed when included in the fuel system. In this way, the fuel tank may be isolated from atmosphere. The status of a canister purge valve (CPV) and/or other valves coupled within a conduit connecting the fuel tank to atmosphere may also be assessed and closed if open. Method 300 then proceeds to 330.

At 330, method 300 includes maintaining the CVV closed until at least the pressure rise curve inflection point. While the engine is still cooling down post shut-down, there may be additional heat rejected to the fuel tank. With the fuel system sealed via the closing of the CVV, the pressure in the fuel tank may rise due to fuel volatizing with increased temperature. As described with regard to FIG. 2D, the fuel tank pressure will undergo an initial pressure rise upon closing the CVV, then begin to flatten out at an inflection point. Continuing at 335, method 300 includes fitting the initial pressure rise (from CVV closing to the inflection point) to a polynomial regression curve. At 340, method 300 includes determining whether the likelihood of the pressure rise test passing (e.g., reaching a threshold pressure) during the test time window is greater than a threshold (e.g., 80%). If the likelihood is greater than the threshold, method 300 proceeds to 345. At 345, method 300 includes maintaining the CVV closed. The CVV may be maintained closed until the fuel tank pressure reaches the pressure rise threshold, the pressure change reaches a plateau, or the end of the test time window is reached.

Continuing at 350, method 300 includes determining whether the pressure rise test recorded a passing result. If the pressure rise test resulted in a passing result, method 300 proceeds to 355. At 355, method 300 includes recording the passing test result. Continuing at 360, method 300 includes opening the canister vent valve. In this way, the fuel system pressure may be returned to atmospheric pressure. Method 300 then ends.

If a vacuum portion of the test is indicated, due to either a likelihood of the pressure rise test being below a threshold, or a failure of the pressure rise test to reach the threshold pressure, method 300 proceeds to 365. The pressure rise test is terminated, and a vacuum portion of the test initiated. However, in some scenarios, the vacuum test may be aborted, the CVV opened, and a flag set to follow up with an EONV test at a subsequent vehicle-off event. For example, if the pressure rise test did not reach the pressure threshold, but less than a threshold duration remains on the test time window, or it is otherwise determined that ambient conditions make the vacuum test unlikely to obtain a conclusive result during the test time window, the test may be aborted.

At 365, method 300 includes opening the CVV and allowing the system to stabilize. Opening the CVV terminates the pressure rise portion of the test, and allows the fuel system pressure to equilibrate to atmospheric pressure. The system may be allowed to stabilize until the fuel tank pressure reaches atmospheric pressure, and/or until consecutive pressure readings are within a threshold of each other. Method 300 then proceeds to 370.

At 370, method 300 includes closing the CVV. In this way, the fuel tank may be isolated from atmosphere. As the fuel tank cools, the fuel vapors should condense into liquid fuel, creating a vacuum within the sealed tank. Continuing at 375, method 300 includes performing a vacuum test. Performing a vacuum test may include monitoring fuel tank pressure for a duration. Fuel tank pressure may be monitored until the vacuum reaches a threshold vacuum indicative of no leaks above a threshold size in the fuel tank. In some examples, the rate of pressure change may be compared to an expected rate of pressure change. The fuel tank pressure may not reach the threshold vacuum. Rather the fuel tank pressure may be monitored for a predetermined duration, or a duration based on the current conditions.

Continuing at 380, method 300 includes determining whether a passing result was indicated for the vacuum test based on the threshold. If the vacuum test resulted in a passing result, method 300 proceeds to 355. At 355, method 300 includes recording the passing test result. Continuing at 360, method 300 includes opening the canister vent valve. In this way, the fuel system pressure may be equilibrated to atmospheric pressure. Method 300 then ends. If a failing test result was indicated, method 300 proceeds to 385. At 385, method 300 includes recording the failing test result. Continuing at 390, method 300 includes opening the canister vent valve. In this way, the fuel system pressure may be equilibrated to atmospheric pressure. Method 300 then ends.

FIG. 4A shows an example timeline 400 for an EONV test on an intact fuel tank where the initial pressure rise indicates that the fuel tank pressure is likely to reach the pressure threshold. Timeline 400 includes plot 405, indicating a vehicle-on status over time, plot 410, indicating a canister vent valve over time, and plot 415, indicating a fuel tank pressure over time. Line 416 represents a pressure threshold for the pressure rise portion of an EONV test. Line 417 represents a vacuum threshold for the vacuum portion of an EONV test. Timeline 400 further includes plot 420, indicating whether a leak is indicated.

At time $t_0$, the vehicle is off, as indicated by plot 405. Accordingly, the canister vent valve is open, as indicated by plot 410. At time $t_1$, the vehicle is turned off. The canister vent valve is left open from time $t_1$ to time $t_2$ to allow system stabilization. At time $t_2$, the canister vent valve is closed, and the fuel tank pressure increases, as indicated by plot 415.

At time $t_3$, the fuel tank pressure rise curve reaches an inflection point. A polynomial curve is fit to the pressure rise curve between time $t_2$ and time $t_3$. In this example, a determination is made that the likelihood of the fuel tank pressure reaching the pressure threshold is greater than a threshold. Accordingly, the CVV is maintained open at time $t_3$. Indeed the fuel tank pressure reaches the pressure threshold indicated by line 416 at time $t_4$. The CVV is then opened, and no leak is indicated, as shown by plot 420.

FIG. 4B shows an example timeline 430 for an EONV test on an intact fuel tank where the initial pressure rise indicates that the fuel tank pressure is unlikely to reach the pressure threshold. Timeline 430 includes plot 435, indicating a vehicle-on status over time, plot 440, indicating a canister vent valve over time, and plot 445, indicating a fuel tank pressure over time. Line 446 represents a pressure threshold for the pressure rise portion of an EONV test. Line 447 represents a vacuum threshold for the vacuum portion of an EONV test. Timeline 430 further includes plot 450, indicating whether a leak is indicated.

At time $t_0$, the vehicle is off, as indicated by plot 435. Accordingly, the canister vent valve is open, as indicated by plot 440. At time $t_1$, the vehicle is turned off. The canister vent valve is left open from time $t_1$ to time $t_2$ to allow system stabilization. At time $t_2$, the canister vent valve is closed, and the fuel tank pressure increases, as indicated by plot 445.

At time $t_3$, the fuel tank pressure rise curve reaches an inflection point. A polynomial curve is fit to the pressure rise curve between time $t_2$ and time $t_3$. In this example, a determination is made that the likelihood of the fuel tank pressure reaching the pressure threshold is less than a threshold. Accordingly, the CVV is opened, and the fuel tank pressure is allowed to stabilize to atmospheric pressure. At time $t_4$, the fuel tank pressure has returned to atmospheric pressure. The canister vent valve is then closed. As heat continues to dissipate from the fuel tank, a vacuum develops in the fuel tank. At time $t_5$, the fuel tank vacuum reaches the vacuum threshold represented by line 447. Accordingly, the canister vent valve is opened, allowing the fuel tank pressure to return to atmospheric pressure, but no leak is indicated, as indicated by plot 450. In this way, the EONV test reaches completion prior to a test time limit indicated by time $t_6$.

As EONV tests rely on heat rejected from the engine to the fuel tank to drive a pressure gradient in the tank once sealed, the test typically includes an entry condition based on the amount of heat rejected during the previous drive cycle. If a threshold amount of heat has been rejected, the controller stays awake, and executes an EONV test. However, the total amount of heat rejected may not be an accurate indicator of EONV test execution success if the timing of that heat rejection is not accounted for. For example, high speed driving is a good source of heat energy rejected to the fuel tank, but a high speed drive followed by a long idle reduces the impact of the high speed drive, as the bulk fuel temperature will decrease during the idling period as heat dissipates. In other words, heat rejected early in the drive cycle has less of an impact on the bulk fuel temperature at a vehicle-off event as compared to heat rejected late in the drive cycle.

FIG. 5 depicts a high-level method 500 for an engine-off natural vacuum test for a vehicle based on a heat rejection index for the previous drive cycle. Method 500 will be described with relation to the system depicted in FIG. 1, but it should be understood that similar methods may be used with other systems without departing from the scope of this disclosure. Method 500 may be carried out by a controller, such as controller 12, and may be stored as executable instructions in non-transitory memory.

Method 500 begins at 505. At 505, method 500 includes determining whether a vehicle-off event has occurred. The vehicle-off event may include an engine-off event, and may be indicated by other events, such as a key-off event. The vehicle off event may follow a vehicle run time duration, the vehicle run time duration commencing at a previous vehicle-on event. If no vehicle-off event is detected, method 500 proceeds to 510. At 510, method 500 includes recording that an EONV test was not executed, and further includes setting a flag to retry the EONV test at the next detected vehicle-off event. Method 500 may then end.

If a vehicle-off event is detected, method 500 proceeds to 515. At 515, method 500 includes determining whether entry conditions for an EONV test are met. For an engine-off natural vacuum test, the engine must be at rest with all cylinders off, as opposed to engine operation with the engine rotating, even if one or more cylinders are deactivated. Further entry conditions may include a threshold amount of time passed since the previous EONV test, a threshold length of engine run time prior to the engine-off event, a threshold amount of fuel in the fuel tank, and a threshold battery state of charge. If entry conditions are not met, method 500 proceeds to 510. At 510, method 500 includes recording that an EONV test was not executed, and further includes setting a flag to retry the EONV test at the next detected vehicle-off event. Method 500 then ends.

Although entry conditions may be met at the initiation of method 500, conditions may change during the execution of the method. For example, an engine restart or refueling event may be sufficient to abort the method at any point prior to completing method 500. If such events are detected that would interfere with the performing of method 500 or the interpretation of results derived from executing method 500, method 500 may proceed to 510, record that an EONV test was aborted, and set a flag to retry the EONV test at the next detected vehicle-off event, and then end.

If entry conditions are met, method 500 proceeds to 520. At 520, method 500 includes determining a heat rejection index for the previous drive cycle. In some examples, the heat rejection index may be based on a drive cycle aggressiveness index. The drive cycle aggressiveness index may be based on an amount of heat rejected by the engine during the previous drive cycle, the timing of the heat rejected, the length of time spent at differing levels of drive aggressiveness, ambient conditions, etc. The heat rejected by the engine may be based on or more of engine load, fuel injected summed over time, and/or intake manifold air mass summed over time.

Figure 6:
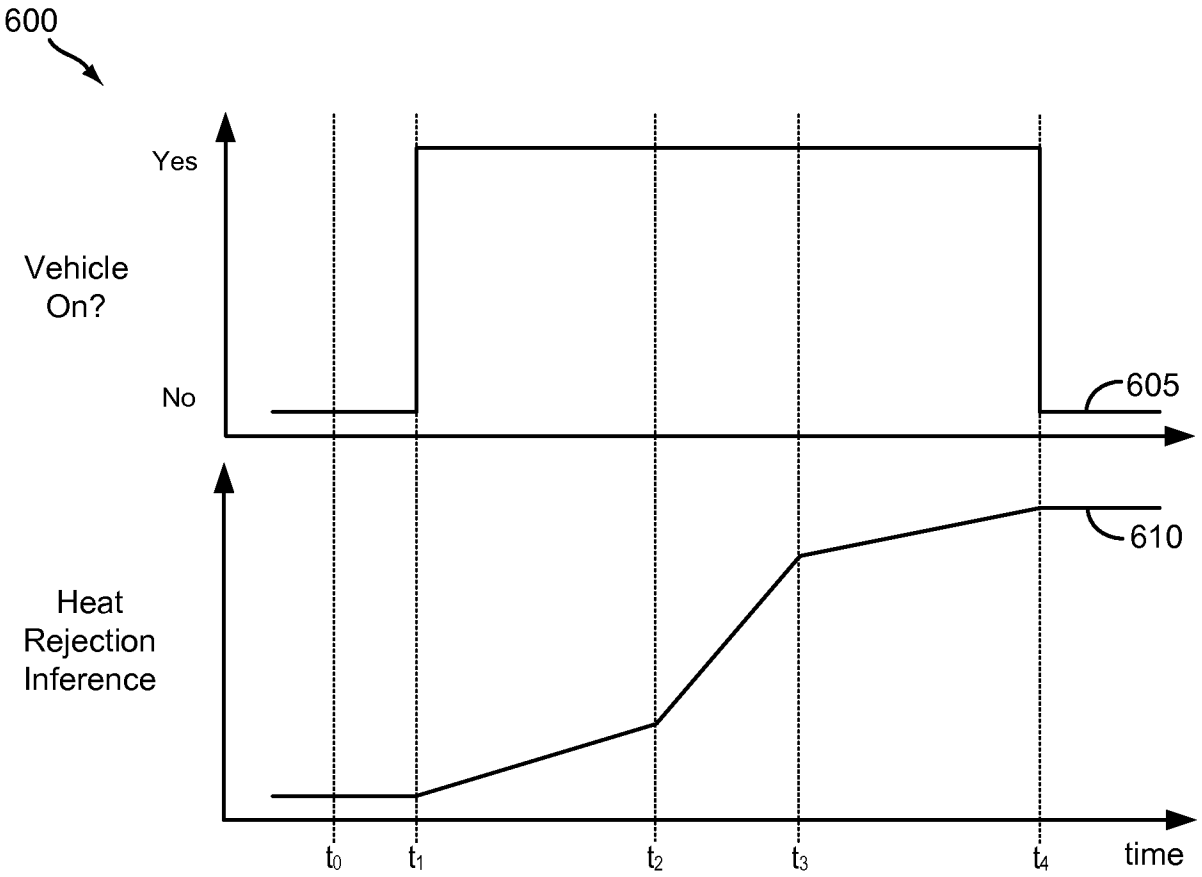
FIG. 6 shows an example timeline for heat rejection from an engine during a drive cycle.

Turning to FIG. 6, an example timeline 600 is shown for heat rejection from an engine during a drive cycle. Timeline 600 includes plot 605, indicating a vehicle-on status over time, and plot 610, indicating a heat rejection inference over time. The heat rejection inference may be based on one or more of engine load, fuel injected summed over time, and/or intake manifold air mass summed over time.

At time $t_0$, the vehicle is off, as indicated by plot 605, and the heat rejection inference is 0, as shown by plot 610. At time $t_1$, the vehicle is turned on. From time $t_1$ to time $t_2$, the vehicle is operated with a first aggressiveness, represented by the slope of plot 610. From time $t_2$ to time $t_3$, the vehicle is operated with a second aggressiveness and from time $t_3$ to time $t_4$, the vehicle is operated with a third aggressiveness. At time $t_4$, the vehicle is turned off.

To determine a drive cycle aggressiveness from time $t_1$ to time $t_4$, both the slope of each segment, as well as the length of time elapsed from the segment to the vehicle-off event may be accounted for. An age factor may be applied that gives more weight to more recent segments, and less weight to less recent segments. For the example shown in FIG. 6, a drive cycle aggressiveness index may be determined with the following equation:

```
Index=[time_1*slope_1*age_factor1+
    time_2*slope_2*age_factor2+
    time_3*slope_3*age_factor3]/[Total Drive
    Cycle Time]
```

Wherein segment 1 extends from time $t_1$ to time $t_2$, segment 2 extends from time $t_2$ to time $t_3$, and segment 3 extends from time $t_3$ to time $t_4$. In this way, the index weighs the aggressiveness (slope) of each segment by segment duration, and ages each segment according to when it occurred in the drive cycle.

The age factor may be a function of time between each segment and the vehicle-off event, and may be stored in a lookup table at the controller. The age factor may be based at least in part on ambient temperature. An example age factor table may be indexed as follows:

| Time elapsed to vehicle-off | Age Factor |
|---|---|
| 10 minutes | 1 |
| 20 minutes | 0.9 |
| 30 minutes | 0.8 |
| 40 minutes | 0.7 |
| 50 minutes | 0.6 |
| 60 minutes | 0.5 |

As such, if aggressive heat generation occurs early in a long drive cycle, such segments are aged out, as natural cooling dissipates rejected heat from the fuel tank. If aggressive heat generation occurs late in a drive cycle, such segments are weighted more heavily, as that heat is more likely to influence the tank temperature at the vehicle-off event. This method may be applied to all vehicle types, and may be particularly useful when applied in start/stop engines and hybrid engines, where engine use may be followed by prolonged idle stops of battery-only drive modes. The drive cycle aggressiveness index may be used both to determine whether to initiate an EONV test, as well as to adjust pressure and vacuum thresholds for an initiated test. In this way, both the robustness and the execution rate of the EONV test may be increased.

Returning to FIG. 5 at 520, in some examples, the heat rejection index may be based at least in part on an exhaust system temperature at the vehicle off event. While the driving aggressiveness index may inform the heat rejection index, the fuel and exhaust system are also prone to cooling from rain, wind, etc. Hence, the exhaust system temperature may provide the most accurate estimation of liquid fuel temperature. A heat transfer model may be based on the configurations of the fuel tank and its heat transfer relationship with the exhaust system. The heat transfer model may then be used to infer liquid fuel temperature based on the exhaust system temperature.

In some examples, the exhaust system temperature may be determined based on the output of a dedicated exhaust temperature sensor coupled to the exhaust passage at a location proximal to the fuel tank. However, the exhaust system temperature may also be inferred using other sensors coupled to the exhaust passage. For example, heated exhaust gas oxygen (HEGO) sensors, such as HEGO sensor 126 and CMS sensor 127 as shown in FIG. 1, include a resistance-based heater element which is used to warm the oxygen sensor to operating temperature during cold starts. Typically, the heater is used for 20-30 seconds, and then turned off. However, as the exhaust temperature increases from engine combustion, the resistance of the heater element increases proportionately. The heater element resistance may thus be used to determine exhaust system temperature. If multiple heater elements are included in an exhaust system, one or more of the heater elements may be used to determine exhaust system temperature.

FIG. 7 schematically depicts an exhaust temperature inference circuit 700 which may be utilized by a controller to determine exhaust temperature. Circuit 700 includes resistance-based heater element 705, which may be included in an exhaust gas oxygen sensor, such as a HEGO sensor and/or a CMS sensor. Heater element 705 is coupled to a first input voltage ($V_{in}$1) 710. First input voltage 710 may be a 12V input, such as the vehicle battery. Heater element 705 is shown coupled to first input voltage 710 via first field effect transistor ($FET_1$) 715. In this way, a controller may actuate $FET_1$ to couple heater element 705 to first input voltage 710, thus causing the heater element to operate. For example, $FET_1$ 715 may be actuated at a vehicle-on event, and then de-actuated when the oxygen sensor coupled to heater element 705 (not shown) reaches a threshold temperature.

In circuit 700, heater element 705 is shown coupled to a second input voltage ($V_{in}$2) 720. Second input voltage 720 may have a lower voltage than first input voltage 710, for example 5V, although other voltages may be used. Heater element 705 is shown coupled to second input voltage 720 via a second field effect transistor ($FET_2$) 725. In this way, a controller may actuate $FET_2$ to couple heater element 705 to first input voltage 720. However, the reduced voltage of second input voltage 720 does not cause the heater element to operate. $FET_2$ 725 may be actuated at a vehicle-off condition or other conditions where an exhaust temperature measurement is indicated, as discussed in method 500.

A resistor ($R_1$) 730 is shown coupled between second input voltage 720 and $FET_2$ 725. In this way, an output voltage ($V_{out}$) 735, is indicative of the resistance of heater element 705. For examples where second input voltage 720 is a 5V input, the resistance of heater element 705 may be determined via the following equation:

$$V_{out}=5*R_{heater}/[R_{heater}+R_1]$$

The exhaust system temperature may then be determined based on $R_{heater}$ and the inherent properties of the heater element (e.g., minimum and maximum resistance). As described above, the exhaust system temperature may then be used to determine a heat rejection index, based on a heat transfer model for the exhaust system and fuel tank. As shown in FIG. 7, heater element 705 is located in the "field" (e.g., coupled within the exhaust system), while the other components of circuit 700 are coupled within the vehicle controller. However, other configurations and circuit designs may be used without departing from the scope of this disclosure.

Returning to FIG. 5 at 520, when a heat rejection index has been determined, method 500 proceeds to 525. At 525, method 500 includes determining whether the index is greater than a threshold. For example, if the index is equal to 0, the engine will not have combusted during the vehicle run time, and thus not have rejected heat to the fuel tank. This would not meet the entry conditions for an EONV test. The threshold index may be predetermined (e.g., 1.5) or may be based on operating and ambient conditions. The threshold may be set at a value indicative that an EONV test is likely (e.g., above a threshold likelihood) to run to completion and provide an accurate pass/fail result. If the determined index is less than the threshold, method 500 proceeds to 510. At 510, method 500 includes recording that an EONV test was aborted, and setting a flag to retry the EONV test at the next detected vehicle-off event. Method 500 then ends.

If the determined heat rejection index is greater than the threshold, method 500 proceeds to 530. At 530, method 500 includes adjusting pressure rise and vacuum thresholds based on the index. The threshold pressures may be based on the current conditions, including the ambient temperature, the fuel level, the fuel volatility, etc. The adjusted threshold pressures may further be based on the inferred amount of heat rejection from the engine to the fuel tank.

Continuing at 535, method 500 includes maintaining the PCM on following the engine-off and/or vehicle off condition. In this way, the method may continue to be carried out by a controller, such as controller 12. Method 500 further includes allowing the fuel system to stabilize following the engine-off condition. Allowing the fuel system to stabilize may include waiting for a period of time before method 500 advances. The stabilization period may be a pre-determined amount of time, or may be an amount of time based on current operating conditions. The stabilization period may be based on the predicted ambient conditions. In some examples, the stabilization period may be characterized as the length of time necessary for consecutive measurements of a parameter to be within a threshold of each other. For example, fuel may be returned to the fuel tank from other fuel system components following an engine off condition. The stabilization period may thus end when two or more consecutive fuel level measurements are within a threshold amount of each other, signifying that the fuel level in the fuel tank has reached a steady-state. In some examples, the stabilization period may end when the fuel tank pressure is equal to atmospheric pressure. Following the stabilization period, method 500 then proceeds to 540.

At 540, method 500 includes closing a canister vent valve (CVV). Additionally or alternatively, a fuel tank isolation valve (FTIV) may be closed where included in the fuel system. In this way, the fuel tank may be isolated from atmosphere. The status of a canister purge valve (CPV) and/or other valves coupled within a conduit connecting the fuel tank to atmosphere may also be assessed and closed if open. Method 500 then proceeds to 545.

At 545, method 500 includes performing a pressure rise test. While the engine is still cooling down post shut-down, there may be additional heat rejected to the fuel tank. With the fuel system sealed via the closing of the CVV, the pressure in the fuel tank may rise due to fuel volatizing with increased temperature. The pressure rise test may include monitoring fuel tank pressure for a period of time. Fuel tank pressure may be monitored until the pressure reaches the adjusted threshold, the adjusted threshold pressure indicative of no leaks above a threshold size in the fuel tank. In some examples, the rate of pressure change may be compared to an expected rate of pressure change. The fuel tank pressure may not reach the threshold pressure. Rather, the fuel tank pressure may be monitored for a predetermined amount of time, or an amount of time based on the current conditions. The fuel tank pressure may be monitored until consecutive measurements are within a threshold amount of each other, or until a pressure measurement is less than the previous pressure measurement. The fuel tank pressure may be monitored until the fuel tank temperature stabilizes. As described with regards to FIG. 3, the initial pressure rise may be used to determine the likelihood of the fuel tank pressure reaching the adjusted pressure rise threshold. Method 500 then proceeds to 550.

At 550, method 500 includes determining whether the pressure rise test ended due to a passing result, such as the fuel tank pressure reaching the adjusted pressure threshold. If the pressure rise test resulted in a passing result, method 500 proceeds to 555. At 555, method 500 includes recording the passing test result. Continuing at 560, method 500 includes opening the canister vent valve. In this way, the fuel system pressure may be returned to atmospheric pressure. Method 500 then ends.

If the pressure rise test did not result in a pass based on the adjusted threshold, and/or was aborted due to a likelihood of the test passing based on the initial pressure rise, method 500 proceeds to 565. At 565, method 500 includes opening the CVV and allowing the system to stabilize. Opening the CVV allows the fuel system pressure to equilibrate to atmospheric pressure. The system may be allowed to stabilize until the fuel tank pressure reaches atmospheric pressure, and/or until consecutive pressure readings are within a threshold of each other. Method 500 then proceeds to 570.

At 570, method 500 includes closing the CVV. In this way, the fuel tank may be isolated from atmosphere. As the fuel tank cools, the fuel vapors should condense into liquid fuel, creating a vacuum within the sealed tank. Continuing at 575, method 500 includes performing a vacuum test. Performing a vacuum test may include monitoring fuel tank pressure for a duration. Fuel tank pressure may be monitored until the vacuum reaches the adjusted threshold, the adjusted threshold vacuum indicative of no leaks above a threshold size in the fuel tank. In some examples, the rate of pressure change may be compared to an expected rate of pressure change. The fuel tank pressure may not reach the threshold vacuum. Rather, the fuel tank pressure may be monitored for a predetermined duration, or a duration based on the current conditions.

Continuing at 580, method 500 includes determining whether a passing result was indicated for the vacuum test based on the adjusted threshold. If the vacuum test resulted in a passing result, method 500 proceeds to 555. At 555, method 500 includes recording the passing test result. Continuing at 560, method 500 includes opening the canister vent valve. In this way, the fuel system pressure may be equilibrated to atmospheric pressure. Method 500 then ends.

If a failing test result was indicated, method 500 proceeds to 585. At 585, method 500 includes recording the failing test result. Continuing at 590, method 500 includes opening the canister vent valve. In this way, the fuel system pressure may be equilibrated to atmospheric pressure.

Continuing at 595, method 500 includes confirming whether a threshold vehicle soak occurred at the next vehicle-on event. In order to confirm the failing test result, the controller may determine whether the fuel temperature had stabilized, thus indicating that the threshold vacuum should have developed in the absence of a fuel system leak. If the fuel temperature has not stabilized (e.g., is greater than ambient temperature), the failing test result may be a false failure. In some examples, the vehicle soak may be confirmed by comparing the engine coolant temperature to the ambient temperature. However, the engine coolant temperature may take longer to stabilize to ambient temperature than does the liquid fuel temperature. As such, the resistance of the HEGO and/or CMS heater element may be used to infer fuel temperature at key on, as the exhaust system temperature may correlate more closely with the liquid fuel temperature than does the engine coolant temperature. If the threshold vehicle soak is confirmed at vehicle-on, method 500 proceeds to 596. At 596, method 500 includes indicating degradation of the fuel system. Fuel tank venting and/or canister purge operations may be adjusted based on the indicated degradation. Method 500 then ends.

If the threshold vehicle soak is not confirmed at vehicle-on, method 500 proceeds to 597. At 597, method 500 includes indicating that the EONV test was aborted, and the failing test result may be deleted. Continuing at 598, method 500 includes setting a flag to retry the EONV test at the next detected vehicle-off event. Method 500 then ends.

Turning to FIG. 8, a timeline 800 is shown for an example evaporative emissions test using the method of FIG. 5 as applied to the system of FIG. 1. Timeline 800 includes plot 810, indicating an vehicle-on status over time, and plot 820, indicating a drive cycle rejection inference over time. Timeline 800 further includes plot 830, indicating a canister vent valve status over time, and plot 840, indicating a fuel tank pressure over time. Line 842 represents a pressure threshold for the pressure rise portion of an EONV test. Line 845 represents a vacuum threshold for the vacuum portion of an EONV test. Timeline 800 further includes plot 850, indicating whether an evaporative emissions leak is indicated over time.

At time $t_0$, the vehicle is off, as indicated by plot 810. Accordingly, no heat rejection is inferred, as indicated by plot 820, and the canister vent valve is open, as indicated by plot 830. At time $t_1$, the vehicle is turned on. The canister vent valve is maintained open while the vehicle is on. From time $t_1$ to time $t_2$, the vehicle operates with a first aggressiveness, indicated by the slope of plot 820. From time $t_2$ to time $t_3$, the vehicle operates with a second aggressiveness, less than the first aggressiveness. From time $t_3$ to time $t_4$, the vehicle operates with a third aggressiveness, less than the second aggressiveness. From time $t_4$ to time $t_5$, the vehicle operates with a fourth aggressiveness, approximately equivalent to the second aggressiveness.

At time $t_5$, the vehicle is turned off, and all engine cylinders are deactivated. The drive cycle aggressiveness, based on the heat rejection inference is greater than the threshold for EONV entry. Accordingly, the pressure rise threshold represented by line 842 and the vacuum threshold represented by line 845 are adjusted to reflect the drive cycle aggressiveness index. In this example, the thresholds are reduced from the pre-determined levels. Although the drive segment from time $t_1$ to time $t_2$ had a relatively high aggressiveness, the aggressiveness was reduced from time $t_2$ to time $t_5$, and the age factor reduces the weight of the early, aggressive segment. The canister vent valve is left open from time $t_5$ to time $t_6$ to allow system stabilization.

At time $t_6$, the canister vent valve is closed, and the pressure rise portion of the EONV test begins. The fuel tank pressure increases from time $t_6$ to time $t_7$, as indicated by plot 840. At time $t_7$, the fuel pressure plateaus. The fuel tank pressure is less than the adjusted pressure rise threshold represented by line 842, but no leak is indicated, as indicated by plot 850. From time $t_7$ to time $t_8$, the canister vent valve is opened, allowing for the fuel tank pressure to equilibrate to atmospheric pressure. At time $t_8$, the canister vent valve is again closed, allowing for the vacuum portion of the EONV test to commence. The fuel tank pressure decreases from time $t_8$ to time $t_9$, as cooling fuel condenses, forming a vacuum in the sealed system. At time $t_9$, the fuel tank pressure reaches the adjusted threshold represented by line 845. Accordingly, no leak is indicated. The canister vent valve is re-opened, allowing the fuel tank pressure to return to atmospheric pressure.

In one example, a method is provided, comprising terminating a pressure rise portion of an engine-off natural vacuum test based on an initial rate of change of a fuel system pressure upon sealing a fuel system; and initiating a vacuum portion of the engine-off natural vacuum test responsive to suspending the pressure rise portion. In some examples, the method may further comprise indicating degradation of the fuel system based on a comparison of a fuel tank vacuum and a threshold. The threshold may be adjusted based on a heat rejection index, the heat rejection index indicative of an amount of heat transferred to the fuel system during a previous drive cycle. In some examples, the heat rejection index may be based on a time-weighted driving aggressiveness index. In some examples, the heat rejection index may be based on a resistance of a heating element of a heated exhaust gas oxygen sensor. The initial rate of change of the fuel system pressure may be determined based on a fuel system pressure change between the sealing of the fuel system, and a subsequent inflection point in a fuel system pressure profile. In some examples, the method may further comprise fitting the fuel system pressure profile to a polynomial; determining a likelihood of the fuel system pressure reaching a pressure threshold; and terminating the pressure rise portion of the engine-off natural vacuum test responsive to the likelihood being less than a threshold. In some examples, the method may further comprise continuing the pressure rise portion of the engine-off natural vacuum test responsive to the likelihood being greater than the threshold. The technical result of this method is an earlier ignition of the vacuum portion of the test. The initial rate of change may indicate a likelihood of the pressure rise portion reaching a pressure rise threshold. Terminating the pressure rise portion early in a test time limit increases the likelihood of a conclusive result being obtained during the test time limit. In other configurations, initiating the vacuum portion of the engine-off natural vacuum test may further comprise: coupling the fuel system to atmosphere; allowing the fuel system pressure to stabilize; and sealing the fuel system. Continuing the pressure rise portion of the engine-off natural vacuum test may include maintaining the fuel system sealed. The heating element of the heated exhaust gas oxygen sensor may be coupled to first and second voltage inputs. The second voltage input may have a lower voltage than the first voltage input. The first voltage input may be coupled to the heating element responsive to an indication to heat an oxygen sensing element of the heated exhaust gas oxygen sensor. The second voltage input may be coupled to the heating element responsive to an indication to determine an exhaust system temperature.

In another example, a method is provided, comprising: adjusting an evaporative emissions leak test parameter based on a time-weighted driving aggressiveness index; and indicating degradation based on the adjusted parameter. The time-weighted driving aggressiveness index may be based on an engine heat rejection inference during a vehicle run time duration. The vehicle run time duration may be a total vehicle run time between a most recent vehicle-off event and a previous vehicle-on event. The engine heat rejection inference may be based on an engine load between the most recent vehicle-off event and the previous vehicle-on event. The time-weighted driving aggressiveness index may weight time periods closer to the most recent vehicle-off event more than time periods closer to the previous vehicle-on event. The evaporative emissions leak test may be an engine-off natural vacuum test. In some examples, the evaporative emissions leak test parameter may be a pressure rise threshold for the engine-off natural vacuum test. The evaporative emissions leak test parameter may be a vacuum threshold for the engine-off natural vacuum test. In some examples, the method may further include initiating the evaporative emissions leak test only when time-weighted driving aggressiveness index is greater than a threshold. The technical result of implementing this method is a decrease in the rate of false failures. The time-weighted driving aggressiveness may provide a more accurate depiction of the heat rejected to the fuel tank at the point of initiating the evaporative emissions leak test. In this way, the leak test parameters may be more indicative of the current operating conditions, and the test may be aborted or adjusted accordingly.

In yet another example a vehicle system is provided, comprising: a fuel system isolatable from atmosphere via one or more valves; and a controller configured with instructions stored in non-transitory memory, that when executed, cause the controller to: adjust one or more thresholds for an engine-off natural vacuum test based on a time-weighted driving aggressiveness index; following a vehicle-off event, isolate the fuel system from atmosphere; and indicate degradation of the fuel system based on the one or more adjusted thresholds. In some examples, the controller is configured with instructions stored in non-transitory memory, that when executed, cause the controller to: responsive to an initial rate of change of fuel tank pressure being less than a threshold, terminating the first testing duration; initiating a vacuum portion of the engine-off natural vacuum test responsive to terminating the first testing duration. The technical result of implementing this system is a decrease in EONV false failure rates. In this way, a drive cycle that concludes with an extended idling period may not meet the entry criteria for an engine-off natural vacuum test, even following a highly aggressive driving period. In other configurations, the one or more adjusted thresholds include a pressure rise threshold, and where the controller is configured with instructions stored in non-transitory memory, that when executed, cause the controller to: monitor a fuel tank pressure for a first testing duration; and responsive to a fuel tank pressure reaching the adjusted pressure rise threshold during the first testing duration, indicate that the fuel system is intact. In some examples, the one or more thresholds may be adjusted based on a resistance of a heating element of a heated exhaust gas oxygen sensor, additionally or alternatively to the threshold adjustments made based on the time-weighted driving aggressiveness index.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

measuring a rate of change of fuel system pressure during an initial pressure rise of an engine-off natural vacuum test, wherein an initial pressure rise is a duration between a sealing of a fuel system and a pressure rise curve reaching an inflection point;

terminating a pressure rise portion of the engine-off natural vacuum test based on a positive initial rate of change of the fuel system pressure being less than a threshold; and initiating a vacuum portion of the engine-off natural vacuum test responsive to terminating the pressure rise portion.

2. The method of claim 1, further comprising:

maintaining closed a valve coupled between a fuel tank and atmosphere for a duration of the vacuum portion of the engine-off natural vacuum test; and following the duration of the vacuum portion of the engine-off natural vacuum test, indicating degradation of the fuel system based on a comparison of a fuel tank vacuum and a threshold.

3. The method of claim 2, wherein the threshold is adjusted based on a heat rejection index, the heat rejection index indicative of an amount of heat transferred to the fuel system during a previous drive cycle.

4. The method of claim 3, wherein the heat rejection index is based on a time-weighted driving aggressiveness index.

5. The method of claim 3, wherein the heat rejection index is based on a resistance of a heating element of a heated exhaust gas oxygen sensor coupled within an exhaust conduit proximal to one or more portions of the fuel system.

6. The method of claim 1, wherein the positive initial rate of change of the fuel system pressure is determined based on a fuel system pressure change that occurs between sealing of the fuel system by closing a valve coupled between a fuel tank and atmosphere, and a subsequent inflection point in a fuel system pressure profile as determined via a pressure sensor coupled between the fuel tank and a fuel vapor canister.

7. The method of claim 6, further comprising:

fitting the fuel system pressure profile to a polynomial;

determining a likelihood of the fuel system pressure reaching a pressure threshold within a predetermined duration; and terminating the pressure rise portion of the engine-off natural vacuum test by coupling the fuel system to atmosphere responsive to the likelihood being less than a threshold.

8. The method of claim 7, further comprising:

continuing the pressure rise portion of the engine-off natural vacuum test by maintaining the fuel system sealed from atmosphere responsive to the likelihood being greater than the threshold.

9. A method, comprising:

adjusting an evaporative emissions leak test parameter based on a time-weighted driving aggressiveness index for an immediately previous drive cycle;

sealing a fuel system from atmosphere;

responsive to a fuel system pressure profile reaching an inflection point while fuel tank pressure is still increasing, determining a likelihood of a fuel system pressure reaching a pressure threshold;

terminating a pressure rise portion of an evaporative emissions leak test responsive to the likelihood being less than a threshold; and indicating degradation based on the adjusted evaporative emissions leak test parameter.

10. The method of claim 9, wherein the time-weighted driving aggressiveness index is based on an engine heat rejection inference during a vehicle run time duration.

11. The method of claim 10, wherein the vehicle run time duration is a total vehicle run time between a most recent vehicle-off event and a previous vehicle-on event.

12. The method of claim 11, wherein the engine heat rejection inference is based on an engine load between the most recent vehicle-off event and the previous vehicle-on event.

13. The method of claim 12, wherein the time-weighted driving aggressiveness index weights time periods closer to the most recent vehicle-off event more than time periods closer to the previous vehicle-on event.

14. The method of claim 9, wherein the evaporative emissions leak test is an engine-off natural vacuum test.

15. The method of claim 14, wherein the evaporative emissions leak test parameter is a pressure rise threshold for the engine-off natural vacuum test.

16. The method of claim 14, wherein the evaporative emissions leak test parameter is a vacuum threshold for the engine-off natural vacuum test.

17. The method of claim 9, further comprising:

initiating the evaporative emissions leak test only when the time-weighted driving aggressiveness index is greater than a threshold and wherein the time-weighted driving aggressiveness index is based on a heat transfer model between an engine exhaust system and a fuel tank.

18. The method of claim 9, wherein the evaporative emissions leak test parameter is further adjusted based on a resistance of a heating element of a heated exhaust gas oxygen sensor coupled within an exhaust conduit, and not based on a dedicated exhaust temperature sensor.

19. A vehicle system, comprising:

a fuel system isolatable from atmosphere via one or more valves; and a controller configured with instructions stored in non-transitory memory, that when executed, cause the controller to:

adjust one or more thresholds for an engine-off natural vacuum test based on a time-weighted driving aggressiveness index;

following a vehicle-off event, isolate the fuel system from atmosphere;

based on an initial rate of change of fuel system pressure being less than a threshold, but not based on an absolute fuel system pressure, and responsive to a pressure rise curve inflection point, terminate a pressure rise portion of the engine-off natural vacuum test; and indicate degradation of the fuel system based on the one or more adjusted thresholds.

20. The vehicle system of claim 19, where the controller is configured with instructions stored in non-transitory memory, that when executed, cause the controller to:

initiate a vacuum portion of the engine-off natural vacuum test responsive to terminating the pressure rise portion of the engine-off natural vacuum test;

indicate a failing test result based on the one or more adjusted thresholds;

couple the fuel system to atmosphere;

at a subsequent vehicle-on event, confirm whether a vehicle soak greater than a threshold occurred, the vehicle soak determined based on a resistance of a heated exhaust gas oxygen sensor; and indicate degradation of the fuel system responsive to the vehicle soak being less than the threshold.

* * * * *